US009322613B2

(12) United States Patent
Oberdick et al.

(10) Patent No.: US 9,322,613 B2
(45) Date of Patent: Apr. 26, 2016

(54) MODULAR SYSTEM WITH ENHANCED SAFETY MECHANISM FOR FIRING NON-LETHAL PROJECTILES FOR CROWD CONTROL

(71) Applicant: NonLethal Technologies, Inc., Homer City, PA (US)

(72) Inventors: James A. Oberdick, Gettysburg, PA (US); Michael Scott Oberdick, Indiana, PA (US)

(73) Assignee: NONLETHAL TECHNOLOGIES, INC., Homer City, PA (US)

( * ) Notice: Subject to any disclaimer, the term of this patent is extended or adjusted under 35 U.S.C. 154(b) by 42 days.

(21) Appl. No.: 14/482,733

(22) Filed: Sep. 10, 2014

(65) Prior Publication Data

US 2016/0018187 A1 Jan. 21, 2016

Related U.S. Application Data

(60) Provisional application No. 61/876,156, filed on Sep. 10, 2013.

(51) Int. Cl.
*F41F 1/08* (2006.01)

(52) U.S. Cl.
CPC .. *F41F 1/08* (2013.01); *F41F 1/085* (2013.01)

(58) Field of Classification Search
CPC ..... F41F 1/08; F41F 1/085
USPC ..... 89/1.41, 37.22
See application file for complete search history.

(56) References Cited

U.S. PATENT DOCUMENTS 1,363,608 A * 12/1920 Luciani ..... F41F 1/08 89/1.41
1,385,120 A * 7/1921 Ekman ..... F41F 1/08 102/383
3,385,163 A * 5/1968 Kotikov ..... F41A 19/21 102/334

FOREIGN PATENT DOCUMENTS

GB 143529 A * 8/1921 ..... F41A 3/40

* cited by examiner

*Primary Examiner* — Troy Chambers
*Assistant Examiner* — Adam J Zimmer
(74) *Attorney, Agent, or Firm* — Birch, Stewart, Kolasch & Birch, LLP

(57) ABSTRACT

A system for firing shell-cased projectiles including multiple barrels and a breech assembly, which includes multiple detonators each aligned to a corresponding one of the barrels. Each detonator may include a plunger coupled to a firing pin, and a solenoid for driving the plunger and firing pin toward the corresponding barrel upon firing, and an actuator-driven mechanical safety device including a slide plate switchable between first and second lateral positions. The slide plate may include multiple entrapment pins, each corresponding to one of the detonators. When the slide plate is in the first lateral position, each of the entrapment pins are positioned so as to obstruct movement of the plunger in the corresponding detonator, thereby rendering the corresponding detonator inoperable to fire even if the corresponding solenoid is actuated. On the other hand, when the slide plate is in the second lateral position, each of the detonators is operable to fire when the corresponding solenoid is actuated.

11 Claims, 11 Drawing Sheets

SECTION A-A

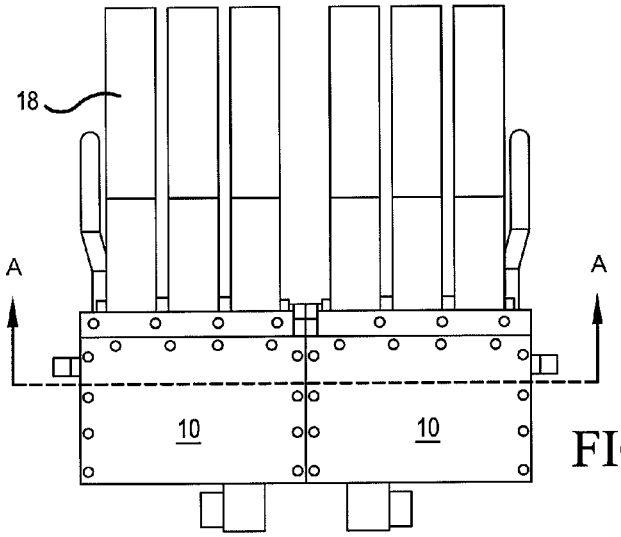
FIG.20
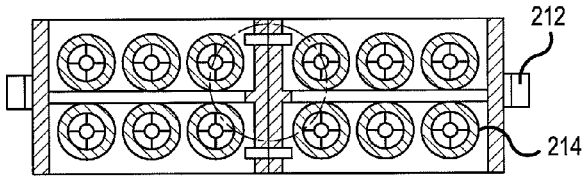
FIG.21 SECTION A-A
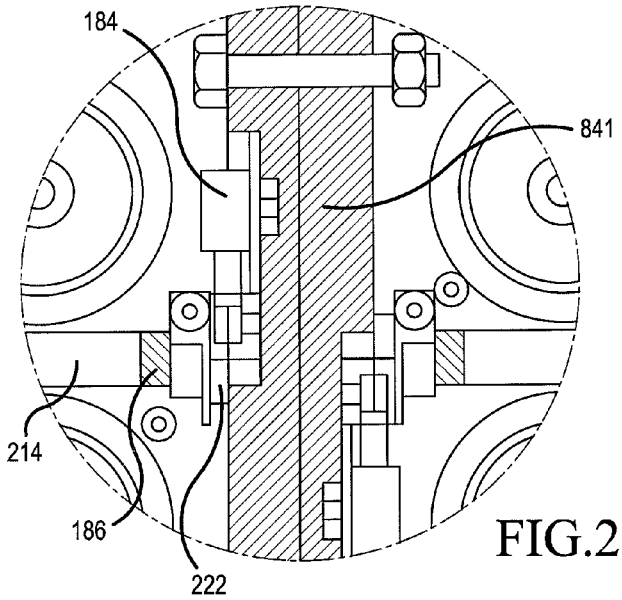
FIG.22

MODULAR SYSTEM WITH ENHANCED SAFETY MECHANISM FOR FIRING NON-LETHAL PROJECTILES FOR CROWD CONTROL

CROSS-REFERENCES TO RELATED APPLICATIONS

The present application claims domestic priority under 35 U.S.C. §119(e) to U.S. Provisional Application No. 61/876,156 filed Sep. 10, 2013, the entire contents of which is hereby expressly incorporated by reference in its entirety.

FIELD OF THE INVENTION

The present application is directed to a weapons system for firing non-lethal shell-cased projectiles, and more particularly, to such a weapons system with enhanced and redundant safety mechanisms for use in crowd control.

SUMMARY OF THE INVENTION

According to an exemplary embodiment, the invention is directed to a system for firing shell-cased projectiles including multiple barrels and a breech assembly, which includes multiple detonators each aligned to a corresponding one of the barrels. Each detonator may include a plunger coupled to a firing pin, and a solenoid for driving said plunger and firing pin toward the corresponding barrel upon firing, and an actuator-driven mechanical safety device including a slide plate switchable between first and second lateral positions. The slide plate may include multiple entrapment pins, each corresponding to one of the detonators. When the slide plate is in the first lateral position, each of the entrapment pins are positioned so as to obstruct movement of the plunger in the corresponding detonator, thereby rendering the corresponding detonator inoperable to fire even if the corresponding solenoid is actuated. On the other hand, when the slide plate is in the second lateral position, each of the detonators is operable to fire when the corresponding solenoid is actuated.

According to a further embodiment, the system may have a redundant safety implemented through a hand knob. Particularly, rotating the hand knob may cause an internal component in the breech assembly to physically prevent the slide plate from transitioning from the first lateral position to the second. In addition, a micro switch may be provided to detect the rotational position of the hand knob, and prevent or enable firing of the detonators based on the detected position.

Further, the present invention may be implemented as modules, each containing a set of barrels and a breech assembly as described above. Such modules may be coupled to one another or stacked.

BRIEF DESCRIPTION OF THE DRAWINGS

FIGS. 20-22 illustrate external and sectional views of pods 10, utilizing hand knobs to provide an additional safety feature, according to an exemplary embodiment.

DETAILED DESCRIPTION

Described hereinbelow is a weapons system for firing and launching impact-primer-fired shell-cased projectiles. This weapons system may be designed to hard-mount on a wide range of land vehicles and marine vessels, or permanent structures such as prisons, government buildings, military base perimeters, or embassy compounds. Exemplary embodiments described hereinbelow with 38 mm shells in mind, but 40 mm or other bore sizes could also be used.

The system described within this specification is advantageous in the following ways. First, and paramount, is operator safety. The system is designed to execute firings remote from the launcher itself. Accordingly, a fire control officer would be able to operate the equipment from inside the safe confines of a vehicle cab, for example, or from some other protected area. In tactile operations, the operator is likely exposed to counterattack and threat or danger, and therefore remote control from a sheltered environment is highly desired.

Second, this weapons system can be manufactured to fire conventional primer-loaded shells. These munitions are highly abundant and relatively inexpensive when compared to squib or electrically-fired munitions.

Third, the system is capable of housing and firing or launching multiple shells. In the system, shells can be grouped or housed together in "banks," thus offering compounded fire power in comparison to traditional single-shot launchers. Based on the configuration of such banks, the potential for massive fire power increases, with all firings originating from a small and compact space. This ability to quickly expend many rounds improves the economics of firing and operating a weapon, especially one that is routinely used, e.g., for training. Based on this combination of features, a sole operator is capable of deploying a mass volley of relatively inexpensive munitions from a safe vantage point, and thus advantageous over "one per man" single-shot handheld systems.

Figure 1:
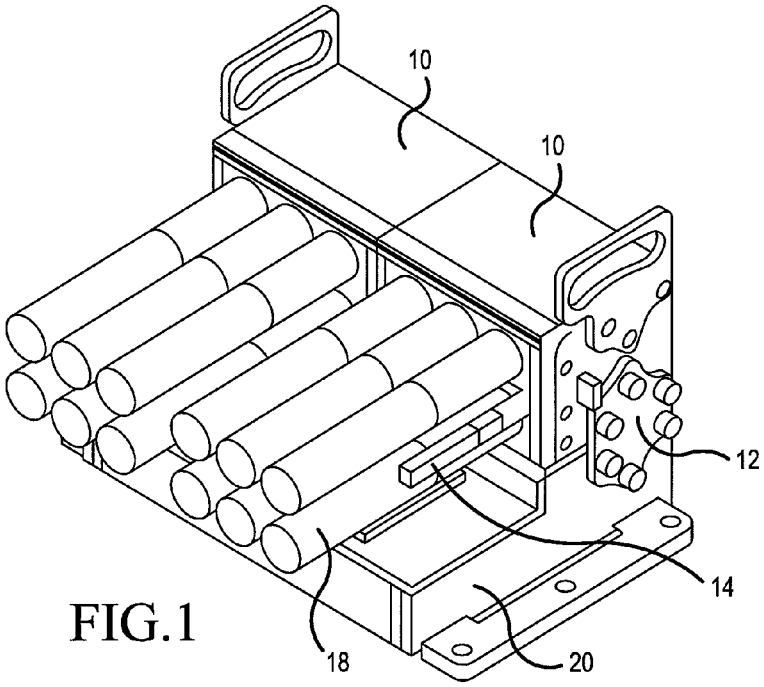
FIGS. 1 and 2 illustrate respective views in which pods, each containing multiple barrels, are coupled and mounted on top of a base unit according to an exemplary embodiment.

FIG. 1 shows an arrangement for a twelve barrel system. In the particular arrangement of FIG. 1, two pods 10 each containing six barrels 18 have been "paired" or "coupled" together. Such pods 10 may be horizontally coupled as shown, e.g., by bolting them together internally. It will be demonstrated why coupling pods are advantageous, but it should be noted that pods 10 can be mounted and used singularly. Further, coupled pods 10 are shown mounted to the base 20, which may in turn be mounted to a surface such a vehicle roof or a vehicle platform, or a stationary location such as a table or frame. While FIG. 1 illustrates the pods 10 as mounted to a base unit 20, it should be recognized that the pods 10 does not need to be hard-mounted to a base 20, but instead can be physically separate from such base 20 so as to be fixed to other remote mounts. This, combined with the ability to install pods 10 in singular fashion, allows for application flexibility.

Figure 2:
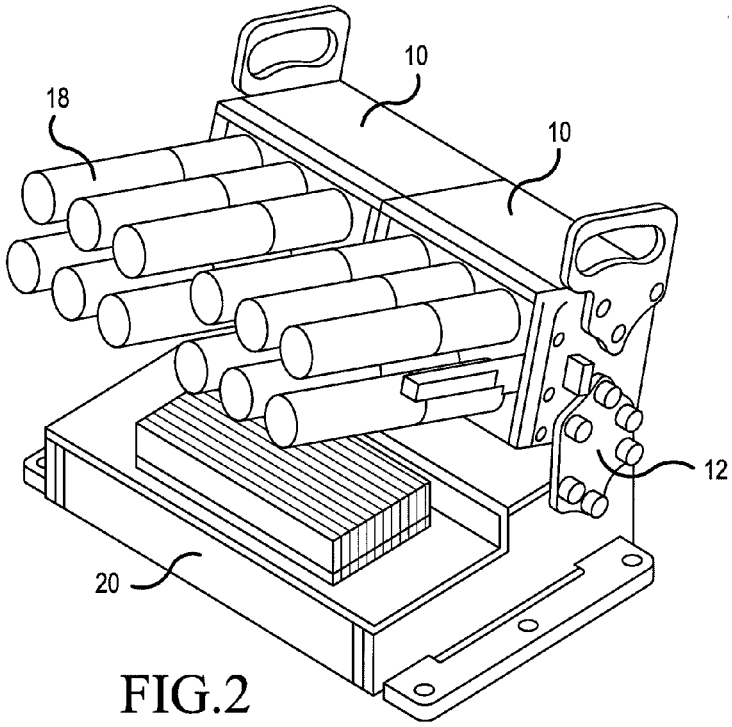

In FIG. 1, the coupled pods 10 are shown as being attached to the base 20 by means of a cam plate 12, which provides angular adjustment and therefore angular trajectory from the base 20 or other means of mounting. FIG. 2 shows the pods 10 adjusted from zero (flat) elevation. Depending upon the design of the cam 12, the pods 10 can be adjusted at a number of pre-designated elevations, or at any point within a chosen fixing range. Pods 10 that are coupled together may be able to share some components that would otherwise be individually provided to uncoupled pods 10. Further, compared to a singular pod arrangement, the coupling of pods 10 illustrated in FIGS. 1 and 2 may conserve space, reduce manufacturing costs and promote easier, safer and faster operation for the user.

In FIG. 1, a breech latch 14 is illustrated as part of the pod 10. This latch 14 will be described in more detail below in connection with FIGS. 6, 11, and 12.

Figure 3:
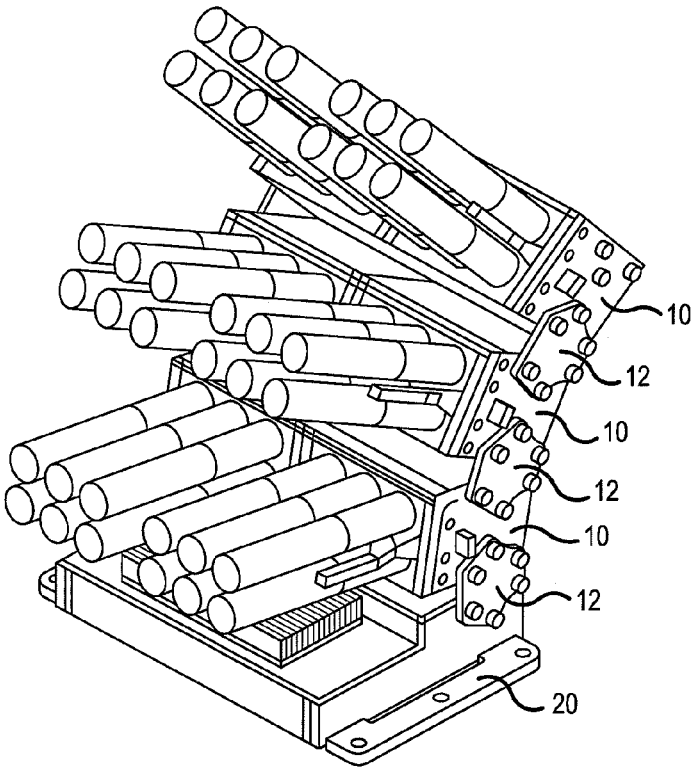
FIG. 3 illustrates the stacking of multiple pods on top of a base unit, according to an exemplary embodiment.

Further, pods 10 (arranged either singularly or coupled) can be stacked as shown, for example, in FIG. 3. The cam plates 12 are used to accomplish the mechanical coupling of pods 10 in a stacked arrangement, again allowing for a variety of possible elevation or angular adjustments. While FIG. 3 illustrates a stack of three sets of coupled pods 10, for a total of thirty-six barrels 18, coupled pods 10 may alternatively be double-stacked to acquire twenty-four barrels 18, or more than three sets of coupled pods 10 may be stacked to increase or decrease weapon capacity.

In general, the component parts of the weapons system may be manufactured from aluminum alloy to help keep overall weight diminished. Further, the parts may be manufactured by conventional computer numerical control (CNC) machining. Alternatively, a manufacturing process utilizing a production CNC screw machine may be used to optimize machining expense.

Figure 4:
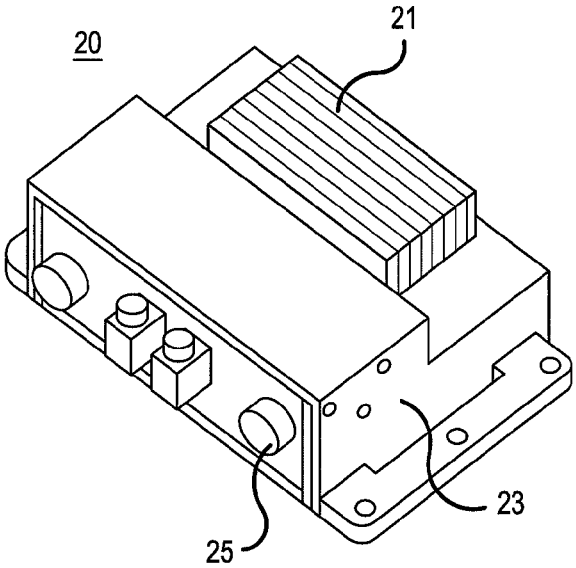
FIGS. 4 and 5 illustrate respective views of a base unit, apart from pods, according to an exemplary embodiment.
Figure 5:
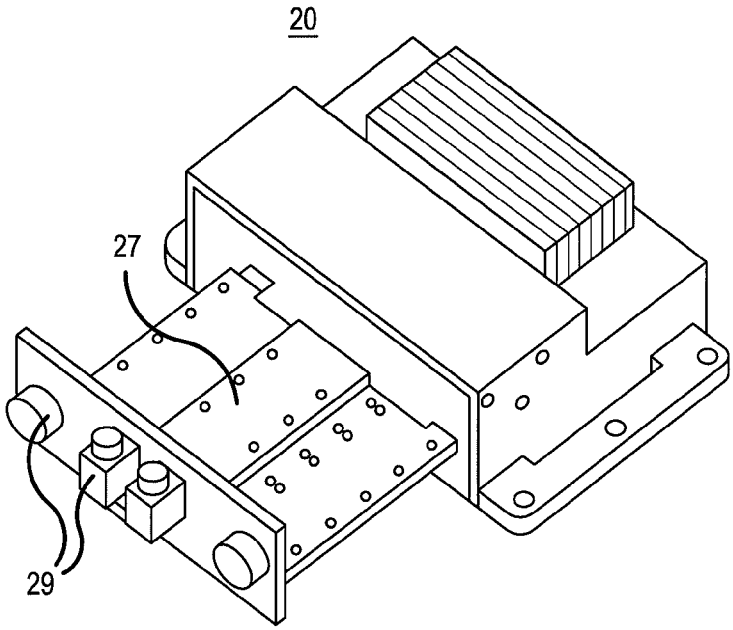

FIGS. 4 and 5 illustrate views of a base unit 20 apart from any pods 10. As shown in these figures, the base 20 may contain a weldment fabrication (i.e., base housing weldment 23) entailed to contain electronics wiring (e.g., embodied in a printed circuit board (PCB) 27) and cable connectors 29 to facilitate the mounting of pods 10. However, the base 20 can be constructed to other shape profiles and designs, and is not constrained by any means to those depicted in FIGS. 4 and 5. The base housing weldment 23 may be fitted with an opening that accepts and accommodates an electronics cassette 25, as well as a conditioning power supply 21 with heat sink. This weapons system is designed for use in various vehicle-mounted applications, for which the supply power can vary from manufacturer to manufacturer (along with power quality). Thus, the power supply 21 can be designed to convert and correct a typical range of supplied DC voltages to the required system voltage. The heat sink of the power supply 21 dissipates heat generated by the conversion process to the ambient surrounding. However, it should be noted that the base 20 need not necessarily be outfitted with a power supply 21 if the required operating voltage is available. Also, it might not be necessary to self-contain the power supply 21, if used, whereas the power supply 21 could instead be remotely located as dictated by the application. Incorporating the power supply 21 in the base 20, however, might be advantageous in certain applications in terms of power maintenance, compactness and taking advantage of factory assembly.

In the base 20 of FIGS. 4 and 5, the electronics cassette 25 may be configured as a "Plug and Play" set of components including at least one PCB-type electronic board 27. For instance, it is contemplated that one PCB board 27 may be configured to control two pods 10. A PCB 27 may be provided with means of "jumpering" to a next PCB 27 in order to interface additional pods 10 two-at-a-time. The electronics cassette 25 is fitted with external cable connectors 29, e.g., "circular connectors" which are often used in military applications. For instance, one cable connector 29 may be used to connect the weapons system to incoming power, and another cable connector 29 could facilitate connection to a remote controller (not shown). In this example, the center cable connectors 29 could be designed to facilitate cable connection to each pod 10, and thus may be equipped with rotational adjustment to allow good cable management for movement in pods 10 which undergo elevation and angle adjustments. In such an embodiment, the arrangement illustrated in FIGS. 4 and 5 would be compatible with a two pod 10 system, and other cable connectors 29 could be added to facilitate the use of additional pods 10.

Referring again to FIG. 5, the electronics cassette 25 is shown as being insertable into and removable from the base 20. Since the wire connections to and from the PCB board(s) 27 are shown as running directly to the external cable connectors 29, the entire electronics cassette 25 could be taken out of the base 20 once the cables have been disconnected. This design would facilitate serviceability, interchangeability and manufacturing efficiency. The electronics cassette 25 can be retained in the base weldment housing 23 and weather-sealed with common fastener hardware.

Figure 6:
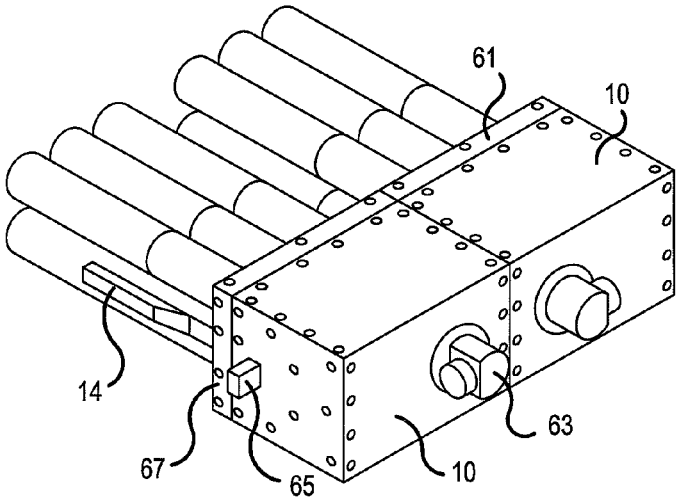
FIGS. 6 and 7 illustrate views of two pods coupled together so as to swing open from the center, and create a safe reloading zone, according to an exemplary embodiment.
Figure 7:
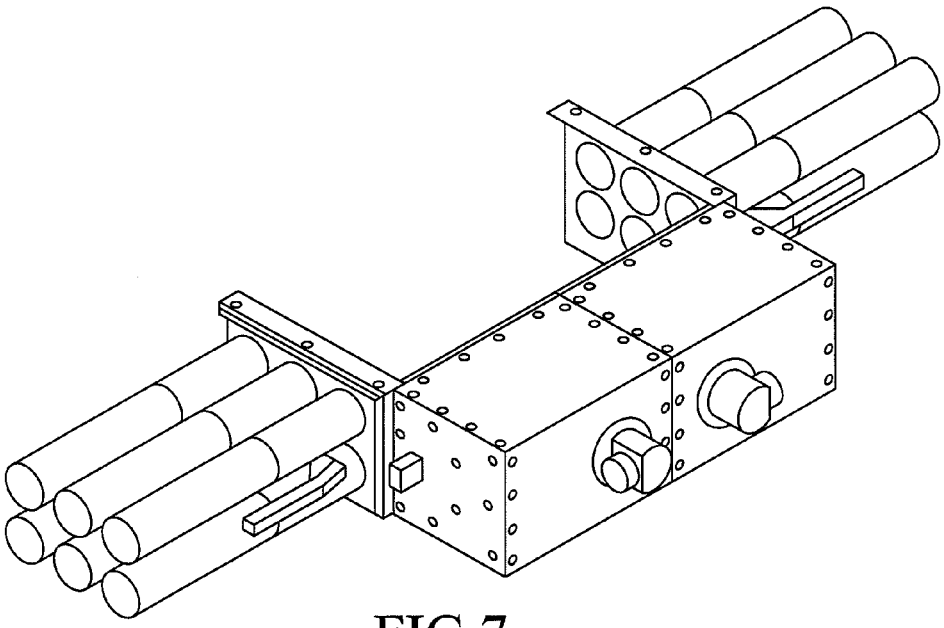

FIGS. 6 and 7 illustrate a set of coupled pods 10. The design and manufacture of the pods 10 are illustrated as primarily symmetrical, with a few exceptions which might be brought about by the choice of assembly arrangement. Symmetry among pods 10 can allow for interchangeability that is advantageous in terms of manufacturing, service and inventory management. For instance, in the case of coupling pods 10 as shown in FIGS. 6 and 7, two identical pods 10 may be side-connected simply by flipping one of them one-hundred-eighty degrees before bolting. Since the pods 10 are also equipped with rotationally-adjustable cable connectors 29 and side-reversible rain guards 61, each pod 10 can be accommodated to either side.

Coupling pods 10 in the manner described above may offer benefits. First, as previously mentioned, this can foster some sharing of components and functionality. All pods 10 may be equipped with a manual safety mechanism 65. Internally, a watchdog electrical circuit (not shown) may monitor the position of the manual safety actuator 65, and coupled pods 10 can share the use of the watchdog circuit. More importantly, however, when it comes to functionality and operation, the actuation of the manual safety mechanism 65 by the controlling officer may be operative for two pods 10 at the same time and from either side of the weapons system. Coupling a pair of pods 10, one inverted and one not, is advantageous in placing a breech hinge 67 and the breech latch 14 of each pod 10 on the outer sides of the gun, even though the breech latching mechanism (to be discussed later) is opposite and centered in the gun. This arrangement helps keeps an operator out of the extreme danger zone which is directly in front of the barrels 18. The breech latches 69 free the breeches to swing open, thereby creating a safe center-reloading zone area. I.e., this causes the barrels 18 and their line of discharge to be typically facing away from (i.e. to the right and left of) the operator.

Figure 8:
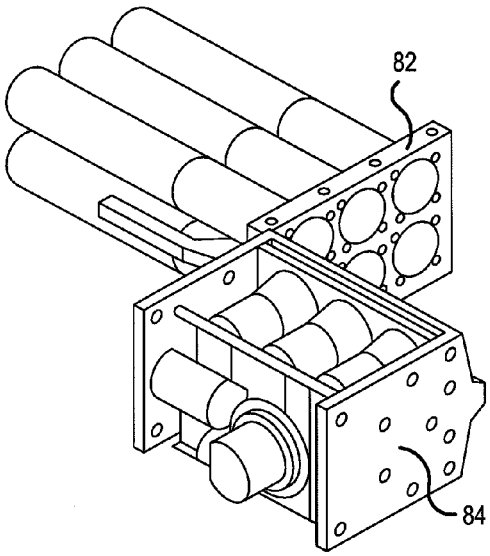
FIG. 8 illustrates a barrel assembly and a breech assembly of a pod according to an exemplary embodiment.

FIG. 8 illustrates a barrel assembly 82 and a breech assembly 84 which, when hinged together, form a given pod 10 of the weapons system. In the embodiment of FIG. 8, the barrel assembly 82 contains six barrels, and the breech assembly 84 is fitted with the firing mechanisms for each barrel, along with a single electro-mechanical safety mechanism.

Figure 9:
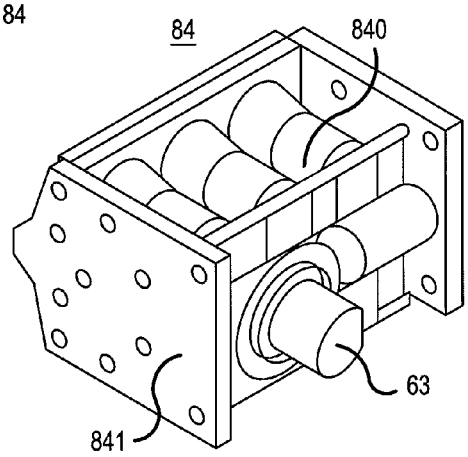
FIGS. 9 and 10 illustrate respective views of a breech assembly according to an exemplary embodiment.
Figure 10:
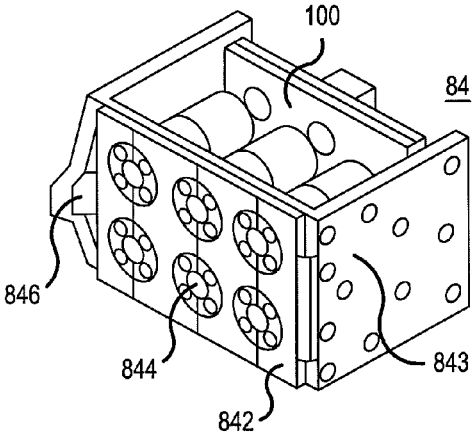

FIGS. 9 and 10 illustrate back and front views, respectively, of a pod's breech assembly 84. As shown in these figures, the breech assembly 84 may comprise a housing of machined plate construction containing a breech plate 842 bolted to side plates, one being a latch side plate 841 and the other a hinge side plate 843. The breech plate 842 is machined with a grid of six mounting holes, each produced to accept its own detonator 840 mounted on the back. An orientation bar mandates mounting of each of the detonators 840 properly, necessary for factory assembly and field service. The detonators 840 may be assembled identical or essentially identical to one another (although this is not strictly required). On the front of the breech assembly 84, as shown in FIG. 10, each bore is fitted with a firing pin plate 844. Further, the locations of these bores are such that they are concentrically aligned to the respective barrels 18 when the barrel assembly 82, which is hinged to the breech assembly 84, is closed and caught or locked fast with the barrel plate catch mechanism 846. Further, each breech assembly 84 can include its own cable connector 63 and an electro-mechanical safety device (including safety mechanism 100).

Internally, the latch side plate 841 of the breech assembly 84 may be machined to accept a small micro switch. Further, horizontally-aligned holes in the side plates 841 and 843 allow passage of a shaft regardless if the pod 10 is coupled to another or not. Outside the latch and hinge side plates 841 and 843, the shaft protrudes enough to be fitted with a detent-in-place hand knob on both sides. These hand knobs can be used to rotate the shaft ninety degrees, from a horizontal "ready-to-fire" position to a vertical "safe" position.

Reference will now be made to FIGS. 20-22 to describe the operational relationship between the micro switch, hand knobs and shaft. Particularly, FIG. 20 illustrates a plan view of a set of coupled pods 10, and FIG. 21 illustrates a sectional view of the pods' breech assemblies 84 (corresponding to section A-A in FIG. 20). FIG. 22 illustrates an enlarged detailed view of part of FIG. 21. The hand knobs 212 and shaft 214 are illustrated in FIG. 21, while the micro switch 184 and shaft 214 are illustrated in FIG. 22. Further, as shown in FIG. 22, a cam 222 may be fixed axially on the shaft 214 inside of the side plate 841. Particularly, this cam 222 is designed to actuate and deactivate the micro switch 184 depending on the rotational position of shaft 214. More detail will be provided below regarding the functionality of these elements as an additional safety feature. For now, it is sufficient to understand that each pod 10 supports passage of this shaft 214, and could include at least one micro switch 184 for monitoring the position of the shaft 214 for purposes of switching the pod 10 between "safe" and "ready-to-fire" states.

Now reference will be made to FIG. 11, which illustrates a view of the barrel assembly 82 of a pod 10. As shown in this figure, multiple barrels 18 may be retained in the barrel plate 822. This barrel plate 822 is a machined plate having a grid spacing matching that of the breech plate 842 of breech assembly 84. The barrels 18 may be retained in the barrel plate 822 by providing, for each barrel 18, fasteners which are secured against one side of a lip on the barrel 18 and which press the lip into a counter bore on the inside of the barrel plate 822. The barrel plate 822 of FIG. 11 is machined with particular features relative to each barrel 18, to be discussed below, along with an external mounting for the hinge 824 and an external mounting for a latch assembly 14B (to which the latch handle 14A is operatively connected).

Figure 11:
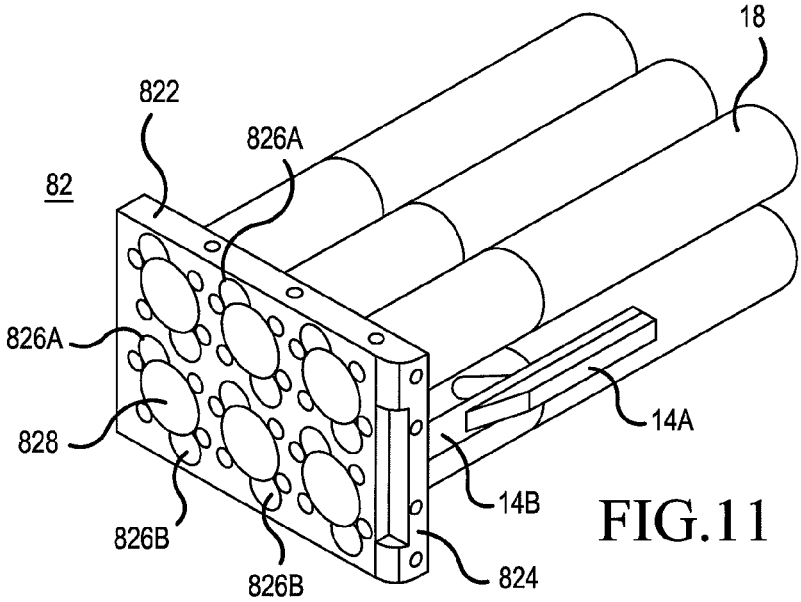
FIG. 11 illustrates a more detailed view of a barrel assembly according to an exemplary embodiment.

Further, as shown in FIG. 11, a thumb slot 826A and a finger slot 826B may be machined on a slight angle into the barrel plate 822 about the center of each barrel location. Each set of thumb slot 826A and finger slot 826B may correspond with a set of slots of similar width, which are machined into each barrel's 18 retention lip, in order to create an access pocket. Further, each barrel 18 may also have an inside counter bore for accepting typical rimmed shell casings.

The purpose of the thumb slots 826A and the corresponding finger slots 826B is to make it easier to deal with munitions that are inserted completely flush with the face of the barrel plate 822, particularly in regard to removal of the spent shells. Traditionally, such removal of spent shells needed to be accomplished with lifters or some other mechanical means of partial ejection which expose an adequate portion of the shell to grasp and remove. The thumb and finger slots 826A and 826B eliminate the need for such lifters and ejection means by providing a space where the operator can simply grasp the shell's lip between the thumb and finger (or two fingers) in order to remove the casing.

Also, while not shown in FIG. 11, a threaded angular hole may be machined into the barrel plate 822 perpendicularly to the axis of the each barrel 18, on or near the barrel's centerline. This threaded hole allows for a clearance hole to be introduced into each barrel 18 after the barrel 18 is secured into place. Further, a soft non-marring ball-nosed spring plunger may be retained with an adjustable depth in this threaded hole, such plunger being backed up or locked in place with a jam screw. This may allow the ball nose of the plunger to protrude inward through the hole in the barrel 18, so as to supply sufficient side force to pinch the munitions casing snugly against the barrel's inside wall. This simple retaining mechanism may allow for slight variation tolerances which are common between munitions manufacturers, without the need for adjustment (although adjustment may be warranted in case of extreme deviation). For such a retaining mechanism, a material such as Delrin® for the soft ball nose may promote good wearability and smooth action without marking or scratching the painted shells. This design can help eliminate the need for the common mechanical lip retention and ejection apparatus usually found in weapons of this nature. While a single retaining mechanism is described above for each barrel 18, a similar design utilizing a circular array of smaller retaining mechanisms in each barrel 18 could be used to accomplish the same function while also improving shell centering when chambering.

Referring again to FIG. 11, the unlocking and unlatching of the barrel assembly 82 from the breech assembly 84 may be facilitated by the latch handle 14A on each pod 10. To conserve space and promote safety, latch handle 14A may reside inward toward the latch assembly 14B, as much as possible, and the latch mechanism latches and unlatches by reversible actions. The latch 14 may operate as follows. The operator can grasp the barrel 18 positioned above the latch 14 and apply simple thumb pressure near the end of the handle 14A. This action causes the latching mechanism to unlock, allowing the natural hand position to draw the barrel assembly 82 open to expose the breech. At no time does the operator need to place his hands or fingers or any body part for that matter at the muzzle or in front of the barrels 18. The latching assembly 14B may also be equipped with a secondary spring-loaded mechanism to always keep the latch 14 in an engaged position unless of course the barrel assembly 82 is being opened. This feature permits the closing and self-latching of the barrel assembly 82 simply by softly slamming it shut without any need to operate the latch handle 14A.

Next, a description will be made of various components within an electro-mechanical safety device of the present weapons system. The primary purpose of the safety device is to block or prevent system firing when the weapons system is set to "safe" mode. Since there are a number of conditions under which system firing should be blocked, the design of this device includes a number of components which can be forced or acted upon to block firing when one of these conditions so demands (thus providing safety redundancy).

Figure 12:
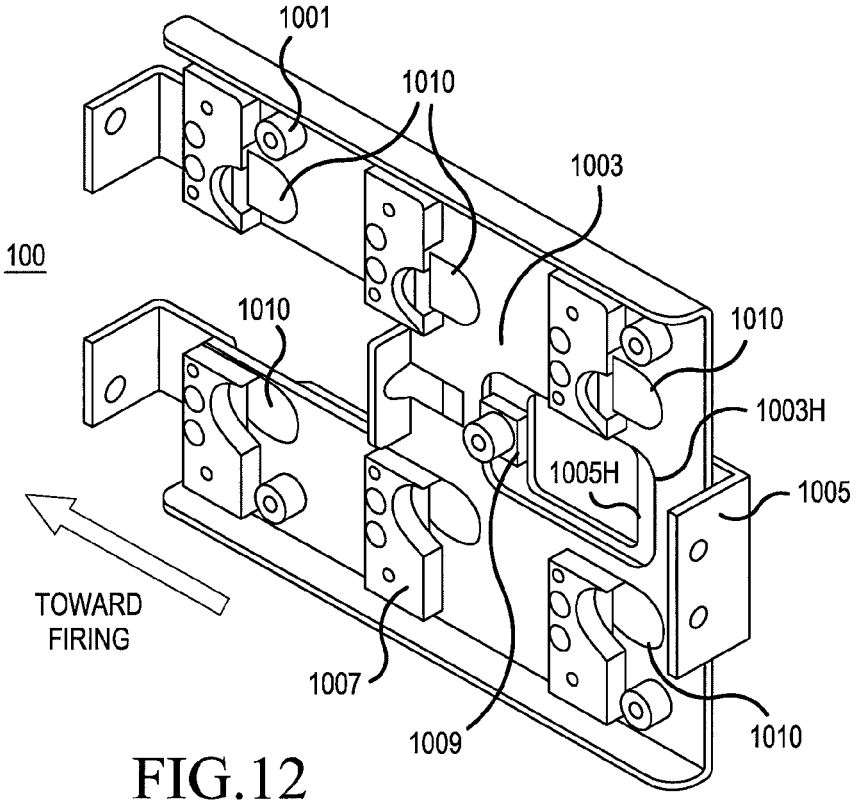
FIG. 12 illustrates components of a safety mechanism of the breech assembly, according to an exemplary embodiment.

FIG. 12 illustrates the mechanical components of an electro-mechanical safety device inside a breech assembly 84. The combination of components illustrated in FIG. 12 will be referred to herein as the safety mechanism 100 of the breech assembly 84. For purposes of clarity, the "electrical" components (including a solenoid and a plunger) of the electro-mechanical device are omitted from FIG. 12, but will be discussed in more detail below in connection with FIGS. 16-19.

The safety mechanism 100 of FIG. 12 may be bolted into place between the side plates 841 and 843 of the breech assembly 84, toward the rear of the pod 10. The safety mechanism 100 includes a safety plate 1005, which is a plate formed with bent tabs and slots for mounting to the side plates 841 and 843 of the breech assembly 84. A slide plate 1003 is mated to the safety plate 1005 in such manner as to be horizontally slidable relative to the safety plate 1005. In FIG. 12, these two plates 1003 and 1005 are shown mated in such manner that the slide plate 1003 is disposed in front of the safety plate 1005. Thus, for the most part, the peripheral portions of the safety plate 1005 are viewable in FIG. 12.

A set of slide guides 1001 are positioned on the sliding plate 1003, as a grid, near the peripheral portions of the safety plate 1005. E.g., four slide guides 1001 are illustrated in the embodiment of FIG. 12. The purpose of the slide guides 1001 is to retain the top and bottom edges of the slide plate 1003 parallel to the top and bottom of the breech assembly 84, while allowing the slide plate 1003 to slide laterally. Further, the slide plate 1003 of FIG. 12 has a rectangular hole 1003H, and the safety plate 1005 has a smaller rectangular hole 1005H. Further, the safety plate 1005 has mounted thereon, at a position corresponding to the slide plate's rectangular hole 1003H, a stop 1009.

Moreover, in FIG. 12, a pattern of through-holes 1010 are machined into the slide plate 1003 and aligned with a corresponding pattern of clearance holes in the safety plate 1005. The clearance holes in the safety plate 1005, however, will be larger than the through-holes 1010 in the slide plate 1003 to ensure alignment in view of horizontal shifting of the slide plate 1003.

The slide plate 1003 of FIG. 12 is shown in its normal "safe" position, so as to block the firing of each of the barrels 18 in a manner that will be described in more detail below in connection with FIGS. 16-19. In the "safe" position shown in FIG. 12, an edge of the rectangular hole 1003R rests against the stop 1009 of the safety plate 1005. Conversely, in an actuated or "ready-to-fire" position, the slide plate 1003 is caused to slide (in the direction of the arrow) so that the center of each hole corresponds with the centerline axis of each barrel 18.

Further, as shown in FIG. 12, entrapment mechanisms 1007 are mounted to the slide plate 1003 in the safety mechanism 100. Particularly, one entrapment mechanism 1007 is mounted next to each hole in the slide plate 1003. Further description of the construction and operation of the entrapment mechanism 1007, as well as the other components in the mechanical safety mechanism 100 (and the electro-mechanical safety device), will be provided below in FIGS. 16-19.

Next, a more detailed description will be provided as to the interactions of aforementioned components of the weapons system, upon assembly, to provide enhanced and redundant safety features.

Figure 13:
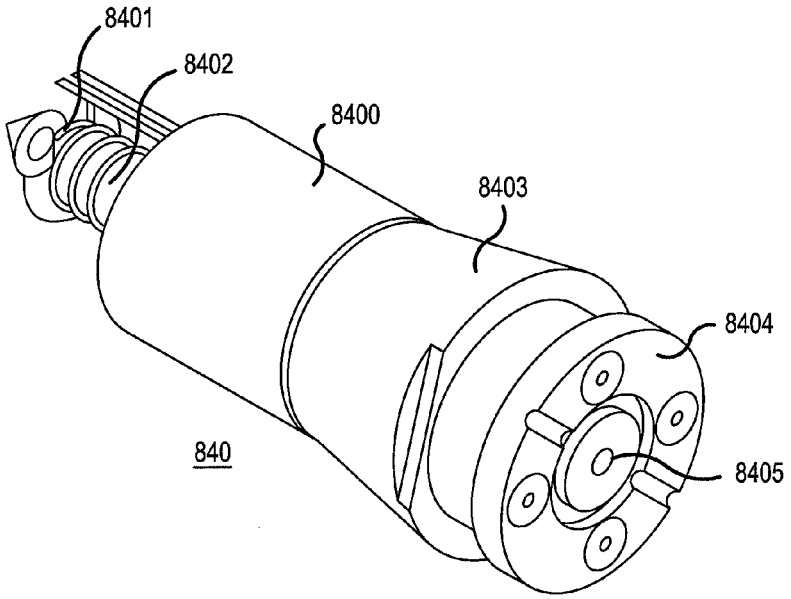
FIGS. 13 and 14 illustrate external and cross-sectional views, respectively, of a detonator implemented within a breech assembly, according to an exemplary embodiment.
Figure 14:
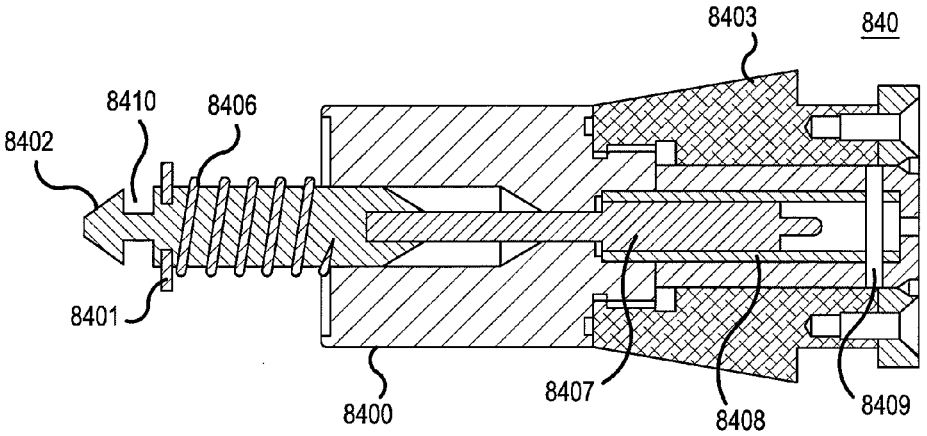

As described above, the breech assembly 84 contains a number (e.g., six) of through bores for the mounting of respective detonators 840. FIGS. 13 and 14 illustrate external and cross-sectional views, respectively, of a detonator 840 which may be implemented in a breech assembly 84. As illustrated in these figures, the detonator 840 includes an electric solenoid 8400 containing windings which, when energized, generate adequate pull force to cause a plunger 8402 to overpower the return force of a spring 8406 and commence traveling inward toward the solenoid 8400. The plunger 8402 is operative to drive a firing pin 8407 within sleeve 8408. Upon firing, the solenoid 8400 causes the firing pin 8407 to achieve enough acceleration sliding through the sleeve 8408 to provide to strike an ignition primer of a loaded shell with enough impact force to detonate the primer. At the end of the plunger stroke (which is stopped by the final impact of the firing pin 8407 on the primer), the spring 8406 is in a nearly compressed state and thus is able to provide enough energy force to return the plunger 8402 and the firing pin 8407 back to their starting positions when the solenoid coil is de-energized.

Of particular note is the shape of the plunger 8406 at the far end away from the solenoid 8400. Here, the plunger 8402 has a tapered end, and a radial groove 8410 next to the taper. This radial groove 8410 will be instrumental to the operation of an electro-mechanical safety device of the weapons system, as will be discussed below in more detail in connection with FIGS. 18 and 19. Further, next to the radial groove 8410, a retaining ring or clip 8401 is provided on the plunger 8402.

The firing pin 8407 of the detonator 840 may be made of non-magnetic material construction so as not to alter the magnetic properties of the solenoid coil. This firing pin 8407 may be fixed to the plunger 8402 during manufacturing by press force or screw threading. The sleeve 8407 may be made of a graphite lubricious special wearing material, which helps reduce friction.

In addition, the firing pin 8407 may be machined with flats parallel to its length. Such flats can reduce surface contact (and thus friction) between the firing pin 8407 and the sleeve 8408 without any sacrifice in guiding. Such flats can also provide better self-cleaning of small particles and fines. However, as an alternative to providing the aforementioned flats on the firing pin 8407, similar benefits could be derived by machining flutes along the length of the sleeve 8408.

The solenoid 8400 is mounted, e.g., by thread mounting, to the solenoid mount 8403. This solenoid mount 8403, in turn, is mounted into one of the bores of the breech plate 842 and retained therein by the installation of a firing pin plate 8404, e.g., with fastener screws). The solenoid mount 8403 may be constructed from aluminum alloy to dissipate heat generated by the solenoid coil 8400. On the cylindrical axis of the detonator 840, a bore is placed concentric through the firing pin plate 8404 and the solenoid mount 8403 to accept an insert 8405. Such a bore can be precision enough to accept insertion of the insert 8405 by slip fit, but tight enough to preserve installed concentricity. The sleeve 8408 has been installed into the inside bore of the insert 8405 by pressing, at the time of manufacture.

The insert 8405 of the detonator 840 may be machined with a small hole to only allow passage of the tip of the firing pin 8407 through its face. In FIG. 14, at a determined distance inward from the face of the insert 8405, an 0-ring 8409 is provided in a radial groove on the outer diameter of the insert 8405. This 0-ring 8409 is designed to provide enough frictional force, when inserted into the solenoid mount 8403, so as to retain the insert 8405 in place. This design provides ease of maintenance for the sleeve 8408 and firing pin simply by pulling the insert 8405 and its attached parts straight out of its bore, e.g., with a hook-type pulling tool. Once the insert 8405 is removed, there is adequate access space to swab the firing pin 8407 per typical cleaning routine. The 0-ring 8409 also seals the bore from dirt and fluids.

Additional features of the firing pin plate 8404 of FIG. 13 include a radial groove introduced into its face, along with two intersecting straight-line grooves, for the purpose of diverting drip water around the small opening for the firing pin 8407. Additionally, the female radial groove can be profiled and sized to specific dimensions so as to only permit special munitions, whose shell casings are produced with a matching male-embossed profile, to be chambered and used in the system at hand. This could be done, e.g., for purposes of proprietary and the implementation of certain safety measures.

Please note, while an electrical solenoid 8400 is described above in connection with the detonator 840, it is possible that another type of solenoid or actuator may be used instead. E.g., a pneumatic solenoid may be used.

Now, a more detailed discussion of the operation of the safety mechanism 100 of the breech assembly 84 will be provided. To understand the operation of this safety mechanism 100, however, a detailed discussion of the configuration and operation of the entrapment mechanism 1007 will be helpful. As such, reference will now be made to FIG. 15 which shows a detailed view of the entrapment mechanism 1007.

Figure 15:
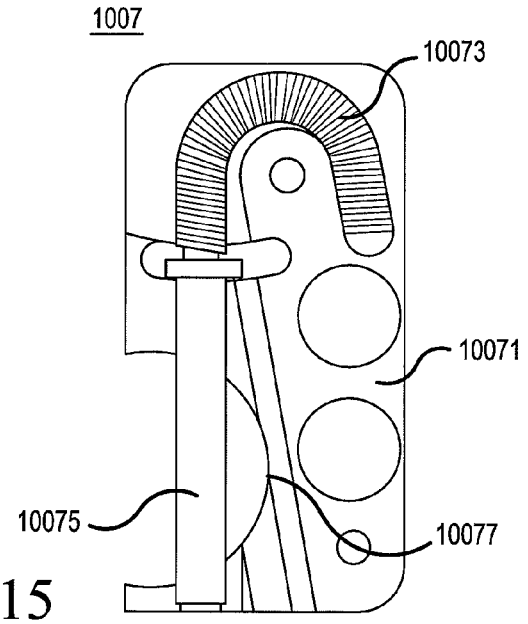
FIG. 15 illustrates an entrapment mechanism, which is implemented in a safety mechanism of a breech assembly, according to an exemplary embodiment.

Particularly, FIG. 15 illustrates the entrapment mechanism 1007 as viewed from the side that would mate to the slide plate 1003 when bolt-mounted. In the entrapment mechanism 1007, an entrapment housing 10071 disposes a cavity containing an entrapment pin 10075 and a coiled spring 10073. The entrapment pin 10075 is machined with a head, and a stem protruding a small distance from the head into the inside diameter of the spring 10073. The head prevents the spring 10073 from slipping downward on the entrapment pin 10075, and also keeps the entrapment pin 10075 from slipping downward, or out of the entrapment housing 10071, by residing itself within a crescent shaped groove. The spring 10073 of FIG. 15 is constrained to a u-shaped cavity, thereby creating and exerting a lateral force upon the entrapment pin 10075 holding the pin 10075 tight against the straight side of the cavity as shown.

It should be noted that use of the term "entrapment pins" should not be construed as being limitative on the shape or dimensions of these components 10075. For instance, the entrapment pins 10075 need not be cylindrical, but instead could be square or rectangular in cross-section.

A set of entrapment mechanisms 1007 are mounted on the slide plate 1003 such that each mechanism 1007 is placed next to a corresponding slotted bore as shown in FIG. 12. When an entrapment mechanism 1007 is thus mounted on the sliding plate 1003, the spring 10073 and the entrapment pin 10075 are completely reserved within the entrapment housing 10071. However, the entrapment pin 10075 is permitted to be forced toward an angled side 10077 of the cavity from an external action that might occur in the area of the partial circle through-bore. When this occurs, by design the entrapment pin 10075 will immediately spring back to the originating side once external force is removed. This arrangement requires an extremely small amount of side pressure to cause the entrapment pin 10075 to swing inward, and is therefore accurately sensitive. The design also lends to exceptionally dependable action capable of high cycling even though the incidence of cycle in real application is particularly low.

Figure 16:
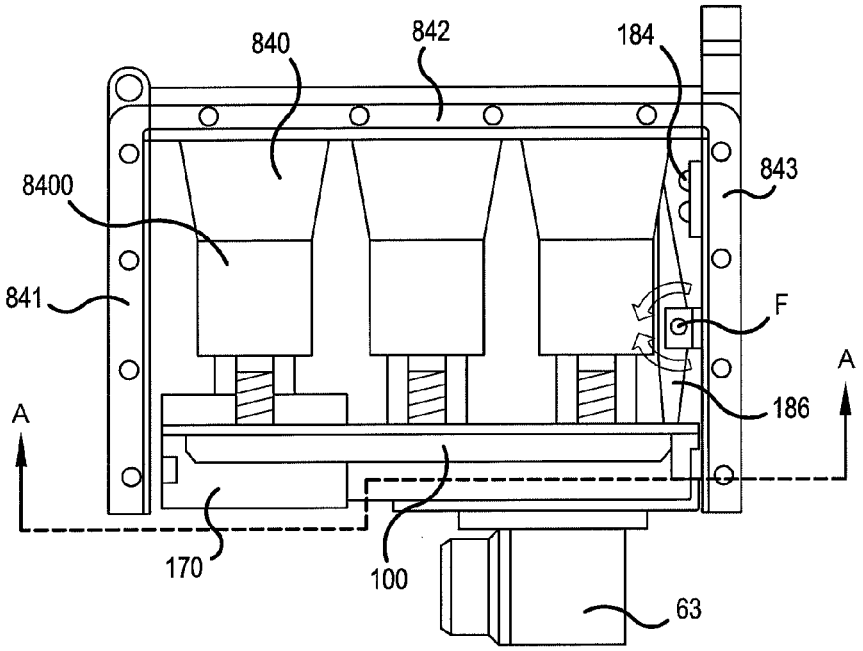
FIGS. 16 and 17 illustrate respective views of a breech assembly to show the positional relationships of the detonators and an electro-mechanical safety device of the breech assembly, according to an exemplary embodiment.
Figure 17:
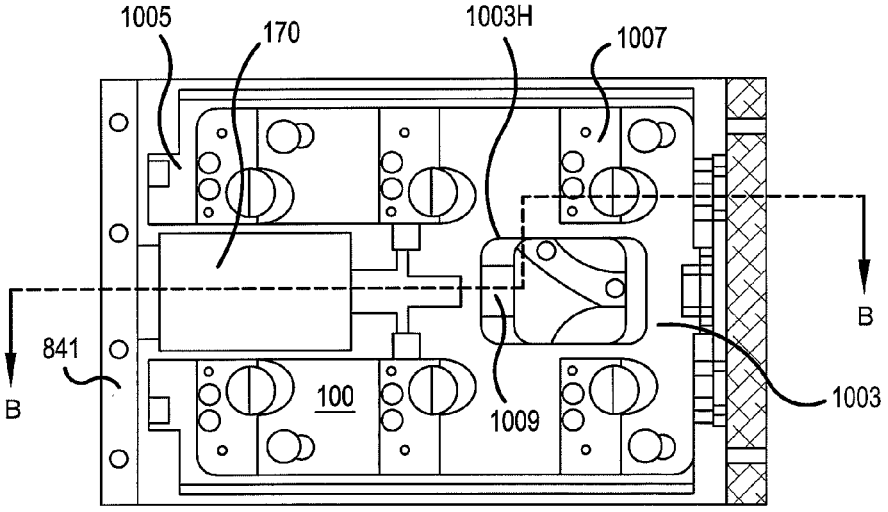

Referring now to FIG. 16, a top view is shown of the breech assembly 84 in order to illustrate the positional relationships between the detonator 840 and components of an electromechanical safety device, including the above-described safety mechanism 100. FIG. 17 provides a sectional view of the breech assembly 84 (corresponding to section A-A in FIG. 16) with certain components (including cable connector 63 and associated wiring) being omitted for clarity.

In FIGS. 16 and 17, the safety plate 1005 and slide plate 1003 have large rectangular holes aligned with one another. These rectangular holes may be provided to allow wires from the cable connector 63 to the solenoids 8400 and the micro switch 184 (see FIGS. 18 and 22) within. These through-passages for the wires are enlarged on the slide plate 1003 so as not to be encumbered when the plate 1003 is shifted.

Further, the slide plate 1003 has a set of holes which are aligned with larger clearance holes in the safety plate 1005, which in turn is aligned with the exact center of each detonator 840. Expanding on the prior discussion of the entrapment mechanism 1007, as illustrated in FIG. 17, each expansion mechanism 1007 is mounted in concentric alignment with a corresponding set of holes in the slide plate 1003 and safety plate 1005 which are aligned with the center of a corresponding detonator 840. This alignment is maintained while the weapons system is in a "safe" mode, at which time the slide plate 1003 is shifted so that rectangular hole 1003H rests against the stop 1009.

Moreover, FIGS. 16 and 17 illustrate a safety solenoid 170 in proximity to the safety mechanism 100. The operation of this safety solenoid, and related components, to transition the system between "safe" and "ready-to-fire" modes will be described below in connection with FIGS. 18 and 19.

Figure 18:
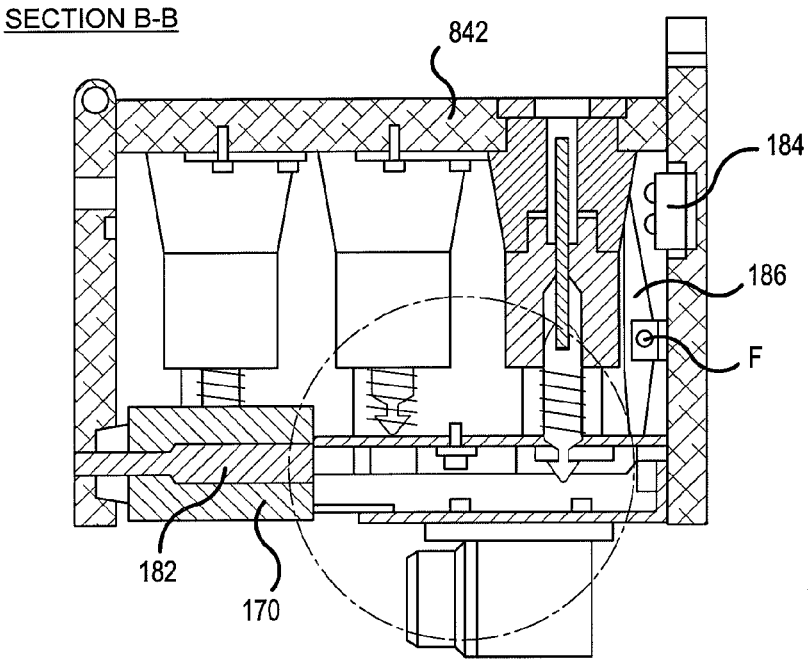
FIGS. 18 and 19 illustrate respective views of a breech assembly to show the use of a safety solenoid and a safety plunger to transition between "safe" and "ready-to-fire" modes, according to an exemplary embodiment.
Figure 19:
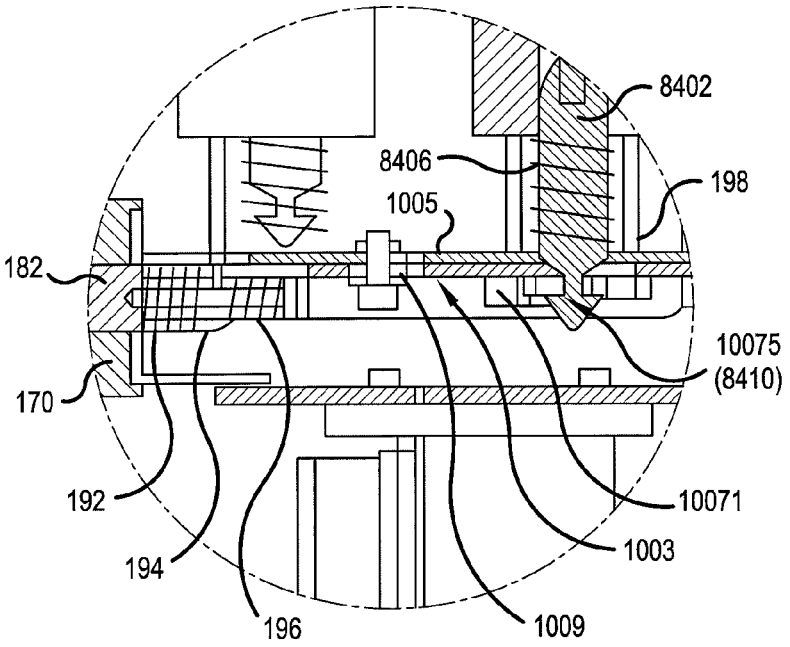

FIG. 18 illustrates another sectional view of the breech assembly 84, that corresponding to section B-B of FIG. 17. Further, FIG. 19 provides a detailed view of a designated (circled) portion of the sectional view illustrated in FIG. 18.

As mentioned above, the plunger 10075 of the detonator 480 assembly has been machined with a tapered end, as well as a radial groove 8410 near the taper. As shown in FIG. 19, when the system is in "safe" mode (and detonator solenoid 8400 is un-energized), the spring 8406 pushes the plunger 8402 toward the safety mechanism 100. The operation of the spring 8406 thus causing the plunger's radial groove 8410 to protrude through the aligned clearance hole in the safety plate 1005 and the corresponding through-hole 1010 in the slide plate 1003. In this position, the radial groove 8410 will be "caught" or "captured" by the entrapment pin 10075 of the corresponding entrapment mechanism 1007. I.e., based on the operation of spring 10073, as the plunger 8402 protrudes through the u-shaped cavity of the entrapment mechanism 1007, the entrapment pin 10075 will first be displaced toward the angled side 10077 (by the plunger's tapered end) before springing back into the radial groove 8410.

With the entrapment pin 10075 being positioned within the radial groove 8410, as described above (and illustrated in FIG. 19), the corresponding detonator 840 is rendered nonfunctional regardless of whether the corresponding solenoid 8400 is energized. That is, in the aforementioned position, the entrapment pin 10075 is easily capable of countering the starting force of the solenoid 8400 thus preventing the plunger 8402 (and attached firing pin 8407) from moving. In addition to countering the actuation of the solenoid 8400, such arrangement prevents any potential for the plunger 8402 and the attached firing pin 8407 to be propelled toward a shell casing primer due to an unexpected external mechanical force, e.g., the impact of a vehicle accident.

Now description will be made of how the electro-mechanical safety device causes the weapons system to transition from the aforementioned "safe" mode to a "ready-to-fire" mode. Particularly, the slide plate 1003 can be caused to shift between the "safe" position (described above) and a "ready-to-fire" position by operation of a safety solenoid 170, which is fixed or mounted to the side plate 841 of the breech assembly 84. As shown in FIGS. 18 and 19, a safety plunger 182 resides in the safety solenoid 170, and is machined to accept a return spring 192 and a collapsible spring coupling 196 which is connected to the slide plate 1003. (The other end of the safety plunger 182 may serve as a visual indicator that protrudes through the housing wall 841, indicating by sight that the slide plate 1003 has in fact been shifted into the "ready-to-fire" position after the safety solenoid 170 is energized). According to an exemplary embodiment, the spring coupling 196, which connects the safety plunger 182 to the slide plate 1003, may comprise a spring-loaded post that slides axially on a precision shoulder screw.

When switching from "safe" to "ready-to-fire" mode, the safety solenoid 170 is energized and applies a pull force on the safety plunger 182 which overpowers the force of the return spring 182, thus causing the safety plunger 182 to move inward toward the safety solenoid 170. Since the safety plunger 182 is connected to the slide plate 1003 via spring coupling 196, the slide plate 1003 will also move toward the safety solenoid, thereby removing the entrapment pins 10075 from their respective positions inside the radial grooves 8410 of the plungers 8402 of detonators 840. Accordingly, movement of the detonator plungers 8402 is no longer obstructed by the entrapment pins 10075. Also, even though the slide plate 1003 has shifted, the corresponding through-holes 1010 are still aligned with the barrels 18 as to allow the plungers 8402 to protrude therethrough. Thus, in this "ready-to-fire" position, the plungers 8402 (and attached firing pins 8407) are ready to be fired when the corresponding solenoids 8400 are energized.

It is noted that the above description uses the term "electro-mechanical" to refer to the above-described safety device. However, this is not intended to limit the safety solenoid 170 to only an electrical type. Another type of solenoid or actuator, e.g., a pneumatic solenoid, may be used instead.

Accordingly, a description has been provided above of an electro-mechanical safety device, including a safety mechanism 100 combined with a safety solenoid 170 and safety plunger 182. While this device is sufficient to enhance the safety of a weapons system designed to fire shell-cased munitions, additional safety redundancy can be provided as will be described below.

Particularly, an operator may be able to use of one or more hand knobs 212 to manually switch the weapons system from a "safe" to "ready-to-fire" state. This feature can be implemented in such manner that operation of the knobs 212 causes a structure (e.g., beam) to physically prevent the slide plate 1003 from moving into a "ready-to-fire" position. Additionally (or alternatively), the rotational position of the hand knobs 212 may be detected by a switch (e.g., micro switch 184), which notifies the electronic system controls to enable or disable firing based on the detected position.

As shown in FIGS. 20-22, perpendicular to the firing solenoids 8400 and just behind the breech plate 842, a shaft 214 may be inserted through aligned holes in the opposing sidewalls of the pod(s) 10. The ends of the shaft can be fitted externally with hand knobs 212. The hand knobs 212 are operable to axially rotate the shaft 214 through an approximate range of ninety degrees, and this rotation can be stopped and held in place by a spring detent machined into the hand knobs 212. Further, this detent may be engaged with hole-depressions in the sidewalls of the pod(s) 10.

It should be noted the shaft 214 can have a hand knob 212 on only one end, or knobs 212 on both ends to allow operation from either side of the weapons system. Further, each shaft 214 may exist in only one pod 10, or traverse through side-to-side coupled pods 10 in which its safety operation will affect both pods 10 in unison.

Now, reference will be made again to FIGS. 16 and 18, which illustrates (in addition to other components discussed above) a beam 186 in plan view. FIG. 22 illustrates the beam 186 in cross section. As shown in FIG. 16, one end of the beam 186 extends toward the safety mechanism 100. Particularly, this end of the beam 186 may protrude through a clearance passage in the safety plate 1005 and into a fixed slot in the slide plate 1003. The other end of the beam 186 is toward the breech plate 842. On the housing wall opposite the safety solenoid 170, there may be mounted a fulcrum F on which the beam 186 is designed to pivot. Particularly, the beam 186 is designed to rotate about the fulcrum F, as shown by the curved arrows, so that the end engaged with the slide plate 1003 will move toward the right as the other end (near the breech plate 842) moves toward the left, and vice versa. Further, the housing wall opposite the safety solenoid 170 includes a recessed pocket toward the breech plate 842, which houses a micro switch 184 (see FIG. 18).

Referring again to FIG. 22, inside the pod 10, a cam 222 is mounted on the shaft 214 in such manner that the cam 222 rotates in synchronization with the shaft 214 and the hand knobs 212. This cam 222 may be located in close proximity to the end of the beam 186 opposite the slide plate 1003. Further, this cam 222 may be helix in nature so that, as the cam 222 is turning according to the rotation of the shaft 214, the cam 222 has a high starting point and thereafter descends to a low ending point as the hand knobs 212 are being turned from the "safe" position to the "ready-to-fire" position.

Accordingly, when the shaft 214 and the cam 222 are in the "safe" position, the helix-shaped cam 222 rotates to its high-point thus blocking a path through which the proximate end of the beam 186 would otherwise freely rotate as the slide plate 1003 shifts from its own "safe" to "ready-to-fire" positions. The other end of the beam 186 is engaged with the slide plate 1003 in such manner that the slide plate 1003 cannot continue to slide toward the safety solenoid 170 (i.e., the "ready-to-fire" position) if the beam 186 is prevented from rotating as such. Accordingly, when the hand knobs 212 are in their "safe" position, the cam 222 mechanically prevents the slide plate 1003 from sliding away from its "safe" position, thus allowing the entrapment pins 10075 to prevent the detonators 840 from firing.

Conversely, when the hand knobs 212 are rotated to the "ready-to-fire" position, the helix cam 222 rotates to its low-point section, thus displacing its high-point section away from the path of the beam 186. As such, the beam 186 is able to freely rotate about the fulcrum F as the slide plate 1003 is shifted into its "ready-to-fire" position.

In addition, based on the use of the breakaway spring coupling 196, the cam design is mechanically advantageous in that it closes matches the connecting force of the spring coupling 196. As a result, even if the safety solenoid 170 is already energized so that the slide plate 1003 has already been shifted into the "ready-to-fire" position, the hand knobs 212 can still be rotated to "safe" position, thereby driving the shaft 214 and cam 222 (and consequently the beam 186) in such manner as to counteract the force of the energized safety solenoid 170 and thus drive the slide plate 1003 back into its "safe" position.

Also, as shown in FIG. 22, the micro switch 184 may be disposed in proximate location to the cam 222, and thus may detect or monitor the cam position. As such, the micro switch 184 may provide feedback to control electronics indicating whether the cam 222 (and thus the hand knob 212) is in a "safe" or "ready-to-fire" position. The electronics, in turn, may implement an electrical or electronic "lockout" of firing in case of detection of a "safe" position.

The mechanical and electro-mechanical safety designs described hereinabove are designed to interact with each other to provide safety redundancy. These mechanics are also integrated to system electronics and control for even greater safety achievements.

Figure 23A:
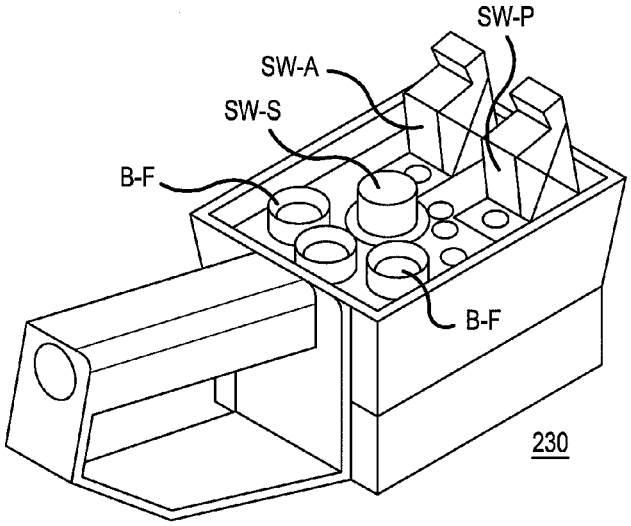
FIGS. 23A and 23B illustrate respective examples of handheld controllers according exemplary embodiments.
Figure 23B:
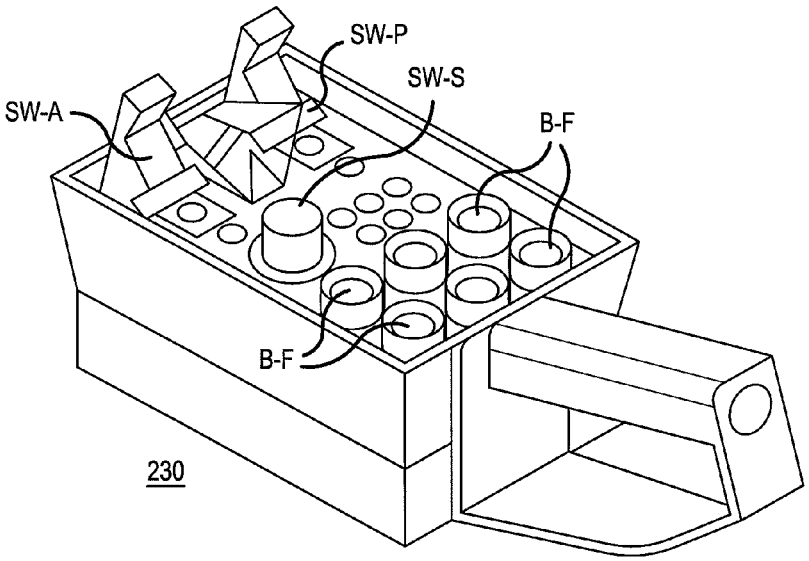

Next, a description will be made of exemplary types of hand-held controllers 230, and corresponding electronics, which may be used to control and operate the weapons system. Particularly, reference is now made to FIGS. 23A and 23B which illustrate respective examples of hand-held controllers 230 which may be utilized by an operator of the weapons systems. The illustrated controllers 230 are just examples, however, and it should be understood that the underlying electronics may be implemented in other enclosures, or completely panel-mounted if desired. Furthermore, although not shown in FIGS. 23A and 23B, cabling or hard-wired connections may be used to connect each controller to the electronics cassette 25.

Further, while portable or hand-held controllers 230 are shown, the corresponding controls may alternatively be implemented in a fixed control console. The selection of what type of panel to be used may vary depending on weapon system size and functionality abilities.

The following control switches should be included in the controller 230: a switch SW-P for powering and initiating the system, and another switch SW-A for "arming" the system, i.e., switching from a "safe" to a "ready-to fire" mode. Light-emitting diodes (LEDs) on the controller panel indicate the status of these switches SW-A, SW-P. A rotary selector switch SW-S, which may also include LED indicators for each position, may show which pod 10 or barrel group has been selected by the operator. Common to all panels is some quantity of "fire" push-buttons B-F. These buttons when depressed initiate the firing sequence of a particular barrel relative to the designated setting of the selector switch SW-S. These buttons B-F may optionally contain integral LEDs for the purpose of informing the operator which barrel has been discharged and which has not. The controller 230 may also contain a specific switch SW-R for resetting the non-volatile memory of the controlling computer and refreshing the LED display, which is routine after reloading the weapon with new munitions. Another feature may include sequential firing, a means of automatically discharging barrels in an ascending manner, one right after the other beginning with a pod 10 chosen by the operator and holding two specific fire buttons B-F down together to launch the sequence.

The controller panel may also include a fault indicator LED for the purpose of indicating abnormal or specific conditions of both the mechanics of the weapon as well as the electronics governing the system. More important than its use for troubleshooting and providing the operator conditional feedback in regard to the current system status, the fault LED is an integral part of safety redundancy.

All of the interface components of the controller panel may be hard-wired to a small PCB board with an on-board computer, which is located within the hand-held controller 230 or in close proximity to the controller if console-mounted. This PCB board can in turn be hardwired to another larger PCB board, also equipped with an on-board computer residing in the launcher base 20 or in an enclosure near the actual weapon, and the connection can be accomplished with just three communications conductors. Respective power conductors for these PCB boards can be coupled in the cabling bundle, but such coupling may not be required. Since the system offers such enhancements in operator functionality, capacity and safety, a typical logic control would require abundant hard-wired interface exceeding forty conductors. The arrangement of limited conductors traveling between the point of control to the point of weapon location promotes ease of installation and augments reliability, especially with increasing distances.

Finally, it is known the PCBs, both those for hand-held controllers 230 and base units 20, have been designed to include CPU technology and facilitating software that can be changed or updated. The board components, those especially pertaining to connection and control of detonator solenoids 8400 and safety solenoids 170, along with those relative to system power, may be designed with silicon transistor technology. Silicon transistors hold extremely good operating characteristics, rugged and reliable. Further, such electronic technology could be interfaced with a specially designed system operating software for providing both low-level and high-level means of monitoring conditions of the weapon primarily for the purpose of safety. Common, low-level checking could pertain to monitoring and verifying correct levels of operating voltages and presence of proper basic connections. High-level checking in the present invention could check for failures in electronics including true solenoid grounding for both safety and firing, sourcing and sinking detection on the same solenoids, internal CPU function and communications verifications, board to board communication confirmations, and higher level wiring failures.

The invention claimed is:

1. A system for firing shell-cased projectiles, comprising:

a plurality of barrels; and a breech assembly comprising:

a plurality of detonators, each detonator being aligned to a corresponding one of said plurality of barrels, said detonator including a plunger coupled to a firing pin, and a solenoid for driving said plunger and firing pin toward the corresponding barrel upon firing, and an actuator-driven mechanical safety device including a slide plate switchable between first and second lateral positions, wherein said slide plate includes a plurality of entrapment pins each corresponding to one of said plurality of detonators, and when said slide plate is in said first lateral position, each of said plurality of entrapment pins is positioned so as to obstruct movement of the plunger in the corresponding detonator, thereby rendering the corresponding detonator inoperable to fire when the corresponding solenoid is actuated, and when said slide plate is in said second lateral position, each of said plurality of detonators is operable to fire when the corresponding solenoid is actuated.

2. The system of claim 1, further comprising a hand knob manually switchable between first and second rotational positions, wherein when said hand knob is in said first rotational position, said slide plate is prevented from being in said second position, and when said hand knob is in said second rotational position, said slide plate is freely switchable between said first and second lateral positions.

3. The system of claim 2, wherein:

switching said slide plate from said first lateral position to said second lateral position requires displacement of a beam, said system further comprises a shaft and cam operably connected to said hand knob so as to rotate in unison with said hand knob, and when said hand knob is in said first rotational position, said cam is rotationally positioned so as to prevent said displacement of said beam if said slide plate is in said first lateral position, and to reverse said displacement of said beam if said slide plate is already switched to said second lateral position, thereby preventing said slide plate from being in said second lateral position.

4. The system of claim 2, further comprising:

a shaft and cam operably connected to said hand knob so as to rotate in unison with said hand knob;

a micro switch configured to detect a rotational position of said cam; and a controller programmed to selectively enable and disable firing for said plurality of detonators, wherein said micro switch transmits data to said controller indicating whether said hand knob is in said first rotational position or said second rotational position based on the detected rotational position of said cam, said controller being programmed to disable firing for said plurality of detonators when said data indicates that said hand knob is in said first rotational position.

5. The system of claim 1, wherein said safety device includes a solenoid for actuating movement of said slide plate between said first and second lateral positions.

6. The system of claim 1, wherein said slide plate includes:

a plurality of through-holes, each aligned with a corresponding one said plurality of detonators such that each through-hole allows the plunger of the corresponding detonator to protrude therethrough; and a plurality of entrapment mechanisms, each disposed at a corresponding one of said plurality of through-holes, wherein each of said plurality of entrapment pins is implemented within a corresponding one of said plurality of entrapment mechanisms.

7. The system of claim 6, wherein each entrapment mechanism includes:

a cavity aligned with the corresponding through-hole to receive the plunger of the corresponding detonator; and a spring into which a head of the corresponding entrapment pin is inserted, a stem of the entrapment pin being urged, by force of said spring, toward said cavity, and for each entrapment mechanism, as the plunger of the corresponding detonator enters through the cavity while said slide plate is in said first lateral position, the corresponding entrapment pin is displaced laterally from the cavity before being urged by force of the spring within a groove of the plunger.

8. The system of claim 7, wherein for each entrapment mechanism, after the plunger of the corresponding detonator has been received through the cavity and the corresponding entrapment pin has been urged within the groove of the plunger, the entrapment pin is caused to slide out of the groove when said slide plate moves from said first lateral position to said second lateral position.

9. The system of claim 1, wherein said plurality of barrels are disposed on a barrel assembly, which is hingedly coupled to said breech assembly, said barrel assembly being configured to be loaded with shell-cased munitions for said plurality of barrels.

10. The system of claim 9, wherein said hingedly-coupled breech assembly and barrel assembly are components of a module, which may be coupled to another similarly-configured module including a breech assembly hingedly coupled to a barrel assembly, and said modules are coupled in such manner that said barrel assemblies open away from each another for loading of shell-cased munitions in the barrels.

11. The system of claim 10, wherein said coupled modules are stackable on another set of similarly-configured coupled modules.

* * * * *